US007591462B2

(12) United States Patent
So

(10) Patent No.: US 7,591,462 B2
(45) Date of Patent: Sep. 22, 2009

(54) MEDIA TRANSFER METHOD AND APPARATUS FOR AUTOMATIC MEDIA DISPENSER

(75) Inventor: Sang-Young So, Iri (KR)

(73) Assignee: LG N-SYS Inc., Seoul (KR)

( * ) Notice: Subject to any disclaimer, the term of this patent is extended or adjusted under 35 U.S.C. 154(b) by 118 days.

(21) Appl. No.: 10/995,164

(22) Filed: Nov. 24, 2004

(65) Prior Publication Data

US 2005/0140080 A1 Jun. 30, 2005

(30) Foreign Application Priority Data

Dec. 26, 2003 (KR) ..... 10-2003-0097706

(51) Int. Cl.
*B65H 1/02* (2006.01)

(52) U.S. Cl. ..... 271/149; 271/10.13

(58) Field of Classification Search ..... 271/10.11, 271/122, 149, 150, 10.13
See application file for complete search history.

(56) References Cited

U.S. PATENT DOCUMENTS 4,039,181 A * 8/1977 Prewer ..... 271/10.11
5,312,098 A * 5/1994 Inoue ..... 271/122
5,449,162 A * 9/1995 Saito et al. ..... 271/122
5,711,518 A * 1/1998 Portaro et al. ..... 271/10.03
5,876,029 A * 3/1999 Wright et al. ..... 271/3.18
5,901,951 A * 5/1999 Yamaguchi ..... 271/10.11
6,059,279 A * 5/2000 Wenthe, Jr. ..... 271/10.13
6,094,561 A * 7/2000 Ushio ..... 399/401
6,182,961 B1 * 2/2001 Wenth, Jr. ..... 271/114
6,234,470 B1 * 5/2001 Okitsu et al. ..... 271/114
6,260,839 B1 * 7/2001 Araki et al. ..... 271/10.11
6,260,840 B1 * 7/2001 Suga et al. ..... 271/10.12
6,499,734 B1 * 12/2002 Tranquilla ..... 271/10.03
6,533,263 B2 * 3/2003 Tamura ..... 271/10.01
6,601,843 B2 * 8/2003 Miki ..... 271/10.13
6,609,707 B1 * 8/2003 Yano ..... 271/10.05
6,736,389 B2 * 5/2004 Kosmoski ..... 271/116
6,896,255 B1 * 5/2005 Fick et al. ..... 271/126
2002/0020959 A1 * 2/2002 Matsuda et al. ..... 271/122
2002/0096817 A1 * 7/2002 Miki ..... 271/10.11
2002/0101025 A1 * 8/2002 Lee et al. ..... 271/10.11
2003/0227124 A1 * 12/2003 Yun ..... 271/10.11
2005/0082739 A1 * 4/2005 Mitsuya et al. ..... 271/10.11

FOREIGN PATENT DOCUMENTS

KR 10-2005-0008393 A 1/2005

* cited by examiner

*Primary Examiner*—Patrick H Mackey
*Assistant Examiner*—Jeremy Severson
(74) *Attorney, Agent, or Firm*—Birch, Stewart, Kolasch & Birch, LLP

(57) ABSTRACT

A media transfer method and apparatus enable media to be separated and discharged out of a media cassette of a media dispenser with a uniform transfer interval. The media transfer apparatus includes a pickup roller in contact with media waiting to be discharged, so as to separate and transfer the media sheet by sheet. A main feed roller and a delivery roller transfer a separated sheet of the media to a media transfer route. A sensor detects a front end of the separated sheet, having passed through a juncture between the main feed roller and the delivery roller. When the sensor detects the front end of the separated sheet, a power supplied to the pickup roller is stopped, and the separated sheet continues to be transferred by the driving power of the main feed roller and the delivery roller.

14 Claims, 2 Drawing Sheets

MEDIA TRANSFER METHOD AND APPARATUS FOR AUTOMATIC MEDIA DISPENSER

BACKGROUND OF THE INVENTION

The present application claims, under 35 U.S.C. § 119, the benefit of Korean Patent Application No. P03-097706 filed Dec. 26, 2003, the entire contents of which are herein fully incorporated by reference.

1. Field of the invention

The present invention relates to a media dispenser. More particularly, the present invention relates to a media transfer method and apparatus, which enables media to be separated, sheet by sheet, and discharged with a uniform transfer interval from a media cassette of the media dispenser.

2. Description of the Related Art

In the present specification, the term "media" refers to sheet materials, such as bank notes, checks, tickets, certificates, etc. The term "media dispenser" refers to an apparatus which automatically supplies such media according to a customer's demand.

FIG. 1 shows a media cassette and a construction for drawing media out of the media cassette, which are employed in a related art media dispenser. A media cassette 1, shown in FIG. 1, is installed in the automatic media dispenser. The media cassette 1 may be either integrated with or separately formed from the automatic media dispenser.

Media m are arranged and stacked in the media cassette 1. In the media cassette 1, the media m are pushed toward a discharge port by a push plate 3, so that they are located in tight contact with each other. The push plate 3 is supported by a spring 5 so as to push the media. The spring 5 provides an elastic force which enables the push plate 3 to push the media.

Each sheet of the media, pushed toward the discharge port by the push plate 3, comes into tight contact with a pickup roller 7 before passing through the discharge port. The pickup roller 7 is located at one end of the media cassette 1, comes into contact with and separates each sheet of the media from the stack, and then moves the separated sheet out of the media cassette 1. The pickup roller 7 may be formed either integrally with the media cassette 1, or separately from the media cassette 1 in the automatic media dispenser.

A feed roller 9 and a contra-roller 10 are disposed close to, and opposed to, each other, so as to promote separation of each sheet of the media from another sheet and transfer the separated sheet. That is, the media are separated and transferred one sheet at a time by the feed roller 9 and the contra-roller 10, while each sheet passes through a gap between the feed roller 9 and the contra-roller 10 rotating in the same direction.

Each sheet of the media, after having passed through the gap between the feed roller 9 and the contra-roller 10, is further transferred by another feed roller or a belt of a delivery module (not shown).

However, the aforementioned related art has the following problems.

In general, one revolution of the pickup roller 7 separates one sheet of the media and transfers the separated sheet into the gap between the feed roller 9 and the contra-roller 10. However, the related art media dispenser may be used for dispensing media of various sizes. Therefore, when the related art media dispenser employs a pickup roller 7 having a fixed size, intervals between transferred sheets of media may be different according to the sizes of the media.

For example, some media may have a size, such as a width, which allows too small an interval between adjacent sheets of the media being transferred. In an extreme case, the media may be overlapped, as in a chain, without an interval between them when transferred. In other words, the related art media dispenser provides non-uniform quality in dispensing media, which changes according to the size of the media.

SUMMARY OF THE INVENTION

Accordingly, the present invention is conceived to solve one or more of the aforementioned drawbacks of the related art. An object of the present invention is to provide a media transfer method and apparatus, which enable media to be separated and discharged out of a media cassette of a media dispenser with a uniform transfer interval.

It is another object of the present invention to provide a media transfer method and apparatus, which enable media of various sizes to be smoothly transferred in a media dispenser regardless of the media size.

According to an aspect of the present invention for achieving the objects, there is provided a media transfer apparatus for an automatic media dispenser, comprising: a pickup roller in contact with media waiting to be discharged, so as to separate and transfer the media sheet by sheet. A main feed roller and a delivery roller transfer a separated sheet of the media to a media transfer route. A sensor detects a front end of the separated sheet having passed through a juncture between the main feed roller and the delivery roller. When the sensor detects the front end of the separated sheet, a power supplied to the pickup roller is stopped, and the separated sheet continues to be transferred by the driving force of the main feed roller and the delivery roller.

The media transfer apparatus may further comprise a feed roller and a contra-roller in contact with, or adjacent to, each other, which are disposed at a portion of the media transfer route between the pickup roller and the main feed roller. The feed roller and contra-roller rotate in a same direction, so as to prevent more than one sheet of the media from being simultaneously transferred.

The feed roller is mounted on a rotation shaft by means of a one-way bearing, so that the feed roller experiences idle rotation without receiving power when the sensor detects the front end of the separated sheet. The idle rotation of the feed roller allows continued transfer of the media.

The contra-roller is driven by a driving force supplied to the contra-roller from a driving source, even when the feed roller experiences idle rotation.

A distance between the pickup roller and the main feed roller is smaller than a dimension (e.g., width dimension) of each sheet of the media in a direction in which the media are transferred.

The main feed roller rotates at a speed at least three times faster than a rotation speed of the pickup roller.

The main feed roller and the delivery roller are in contact with each other by an engagement force at least three times greater than an engagement force between the pickup roller and the media waiting to be discharged.

The pickup roller is mounted on a rotation shaft by means of a one-way bearing, and the pickup roller experiences idle rotation without receiving power when the sensor detects the front end of the separated sheet. The idle rotation of the pickup roller allows continued transfer of the media.

A distance from a contact point between the main feed roller and the delivery roller to a contact point between the pickup roller and the media corresponds to (e.g., is approximately equal to or slightly less than) a dimension (e.g., width dimension) of a sheet of media with a smallest size to be dispense, taken in a direction in which the media is to be transferred.

According to another aspect of the present invention, there is provided a media transfer method for an automatic media dispenser, the method comprising the steps of: separating media waiting to be discharged from a media cassette of the automatic media dispenser by means of a pickup roller sheet by sheet; detecting by means of a sensor a front end of the separated sheet having passed through a juncture between the main feed roller and the delivery roller, stopping operation of the pickup roller when the sensor detects the front end of the separated sheet; and transferring the separated sheet by means of a main feed roller and a delivery roller.

The pickup roller can be operated again after the separated sheet passes a gap between the main feed roller and the delivery roller.

A first feed roller and a contra-roller can be disposed at a portion of a media transfer route, between the pickup roller and the main feed roller. The first feed roller and contra-roller are in contact with, or adjacent to, each other, and rotate in a same direction, so as to prevent more than one sheet of the media from being simultaneously transferred.

Power, supplied to the feed roller, is stopped and the feed roller experiences idle rotation, when the sensor detects the front end of the separated sheet.

The contra-roller continues to rotate and prevents a double sheet from being transferred along the media transfer route even when the feed roller experiences idle rotation.

Power supplied to the pickup roller is stopped and the pickup roller experiences idle rotation, when the sensor detects the front end of the separated sheet.

The main feed roller rotates at a speed at least three times faster than a rotation speed of the pickup roller.

The main feed roller and the delivery roller are in contact with each other by an engagement force at least three times greater than an engagement force between the pickup roller and the media waiting to be discharged.

According to the present invention, media having various sizes can be filled in and dispensed from one automatic media dispenser without any structural changes in the design or construction of the automatic media dispenser. Further, according to the present invention, each sheet of the media can be separated and discharged from a media cassette in a more smooth and exact manner.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Hereinafter, preferred embodiments of a media transfer method and apparatus for an automatic media dispenser according to the present invention will be described in detail with reference to the accompanying drawings.

Figure 1:
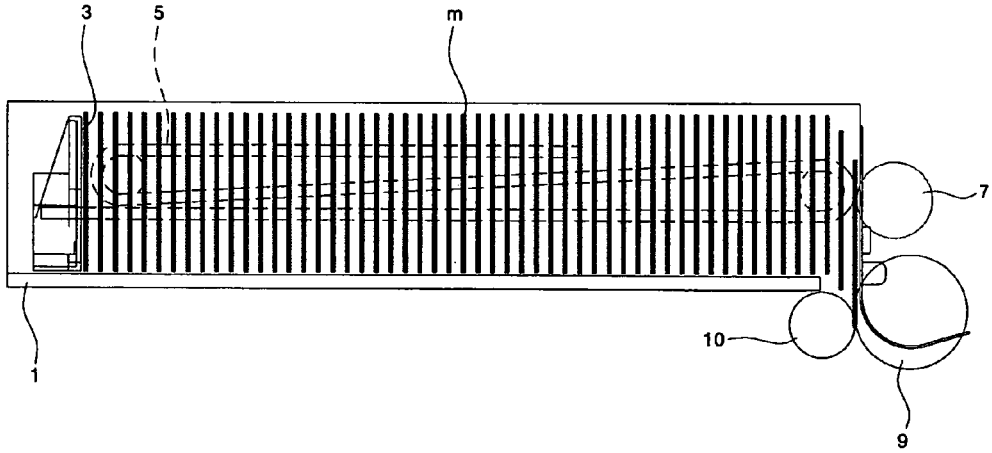
Fig. 1 Related Art
FIG. 1 is a schematic sectional view of a media cassette and a construction for drawing media out of the media cassette of an automatic media dispenser, in accordance with the related art.
Figure 2:
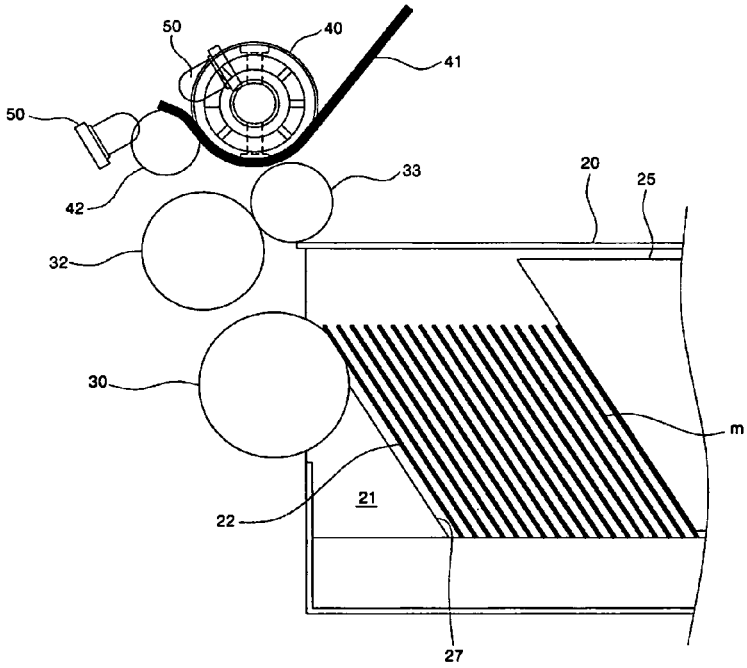
FIG. 2 is a schematic side view of a media transfer apparatus for an automatic media dispenser, according to the present invention.

FIG. 2 is a schematic side view of a media transfer apparatus for an automatic media dispenser, according to the present invention. As shown, a media cassette 20 provided in an automatic media dispenser has a storage space 21 formed therein, for containing media to be dispensed. The media cassette 20 may be either formed integrally with the media dispenser or detachably connected to the automatic media dispenser. The media cassette 20 has a discharge port 22 formed at one side thereof, through which the media m are discharged.

In the media cassette 20, the media m are pushed toward the discharge port 22 by a push plate 25. In the present embodiment, the push plate 25 has an inclined front surface, so that the media are pushed by the push plate 25, while being inclined at a predetermined angle. The media m, pushed by the push plate 25, are supported in an inclined manner by an inclined guide member 27, formed at a portion of the dispenser adjacent to the discharge port 22. The inclined guide member 27 has an opening, formed at a middle portion thereof, which allows a pickup roller 30 to be inserted through the inclined guide member 27. The opening is larger than the pickup roller 30 so as to prevent the pickup roller 30 from interfering with the inclined guide member 27.

The pickup roller 30 enters the discharge port 22 in such a manner that a portion of the pickup roller 30 is inserted in the media cassette 20. The pickup roller 30 rotates while being in direct contact with the media m in the media cassette 20, so as to discharge the media m, sheet by sheet, through the discharge port 22. The pickup roller 30 is mounted on a rotation shaft by means of a one-way bearing. The rotation shaft of the pickup roller 30 may be supported by a separate bracket, and this bracket can be rotated about another shaft by an elastic force of an elastic member. This arrangement causes the pickup roller 30 to come into tight contact with the media m.

A first feed roller 32 is disposed after, or downstream of, the pickup roller 30. The first feed roller 32 is mounted to its rotation shaft by means of a one-way bearing. The first feed roller 32 and the pickup roller 30 may be rotated either by the same driving force from the same driving source, or by driving forces from driving sources different from each other.

A contra-roller 33 is disposed facing to and possibly in contact with the feed roller 32, so as to allow the media m to pass through a second gap or juncture between the first feed roller 32 and the contra-roller 33. The contra-roller 33 rotates in the same direction as that in which the first feed roller 32 rotates, so as to prevent more than one sheet of the media from simultaneously passing through the second gap or juncture between the first feed roller 32 and the contra-roller 33. It is preferred that the first feed roller 32 has a surface having a frictional force larger than that of the surface of the contra-roller 33.

Figure 3:
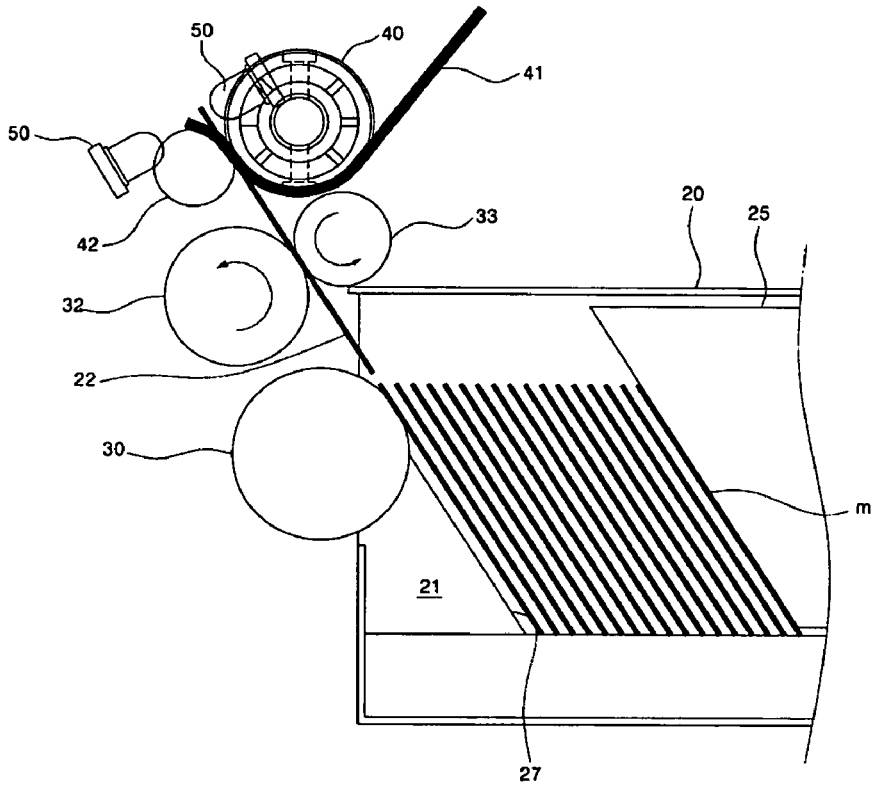
FIG. 3 is a schematic side view for describing an operation of the media transfer apparatus shown in FIG. 2.
Figure 4:
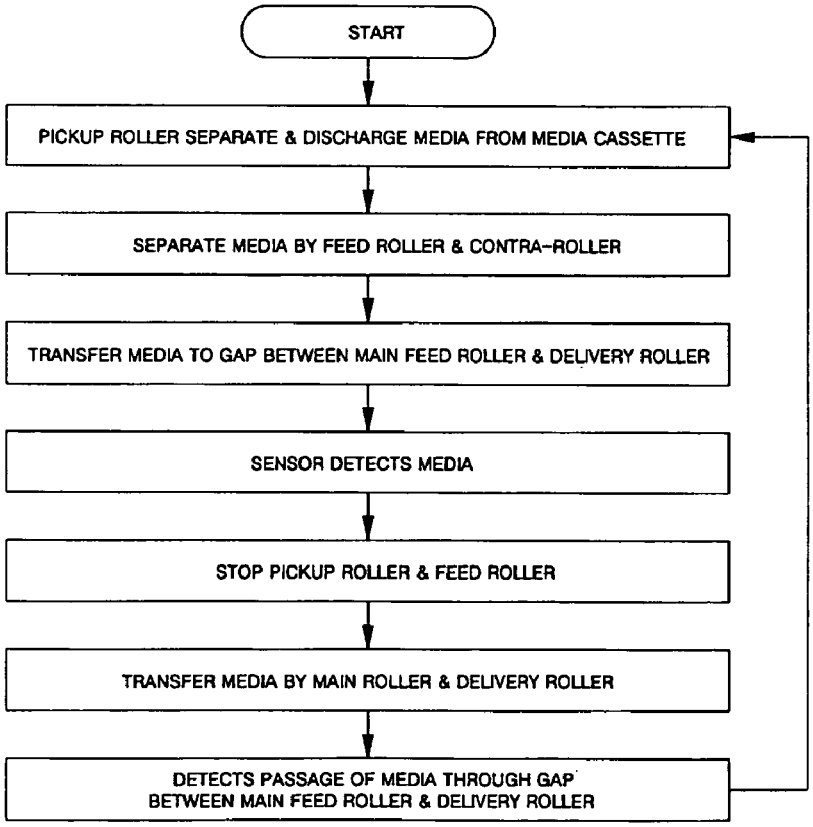
FIG. 4 is a flow chart of a media transfer method for an automatic media dispenser, according to the present invention.

Here, the rotation of the first feed roller 32 and the contra-roller 33 in the same direction signifies, for example, counterclockwise rotation of both the first feed roller 32 and the contra-roller 33 in a view from one side of them toward their rotation centers, as shown in FIGS. 2 and 3. The rotation of the first feed roller 32 and the contra-roller 33 in the same direction, as described above, causes the media to be pushed in opposite directions at the point at which the first feed roller 32 and the contra-roller 33 are adjacent or in contact with each other, thereby preventing more than one sheet of the media m from simultaneously passing through the second gap or juncture between the first feed roller 32 and the contra-roller 33.

A main feed roller 40 and a delivery roller 42 are disposed after, or downstream of, the first feed roller 32 and the contra-roller 33 and are in contact with each other. The main feed roller 40 and the delivery roller 42 are designed to rotate at a speed three or four times faster than a rotation speed of the pickup roller 30. Further, it is preferred that the main feed roller 40 and the delivery roller 42 are in contact with each other by an engagement force at least three times greater than an engagement force between the pickup roller 30 and a sheet of media waiting to be discharged.

A sensor 50 is disposed at a portion directly after, or downstream of, the main feed roller 40 and the delivery roller 42, in a route along which the sheet of media is transferred. The sensor 50 detects a front end of the sheet of the media, transferred through a first gap or juncture between the main feed roller 40 and the delivery roller 42. The sensor 50 provides a signal used for stopping the driving force supplied to the pickup roller 30, when the sensor 50 detects the sheet of the media exiting from the first gap or juncture between the main feed roller 40 and the delivery roller 42.

It is preferred that the distance from a contact point between the main feed roller 40 and the delivery roller 42 to a contact point between the pickup roller 30 and the media m corresponds to a dimension of a medium m with a smallest size, taken in the direction in which the medium is transferred. More specifically, the distances described above should be designed to have values which allow the pickup roller 30 to be in contact with a sheet of the media m when a front end of the sheet is detected by the sensor 50. Reference numeral 41, not described above, designates a belt for transferring the media.

Hereinafter, the operation of the media transfer apparatus of the automatic media dispenser, according to the present invention, will be described in detail. First, when the automatic media dispenser is operated, the pickup roller 30 rotates. Of course, the feed roller 32, the contra-roller 33, the main feed roller 40 and the delivery roller 42 also rotate. By the rotation of the pickup roller 30, the media m in the media cassette 20 are separated and discharged through the discharge port 22 sheet by sheet. Each sheet of the media m, having been discharged out of the discharge port 22, is transferred to the second gap or juncture between the feed roller 32 and the contra-roller 33.

As shown in FIG. 3, the feed roller 32 and the contra-roller 33 rotate in the same direction. Therefore, if two sheets of the media m are simultaneously transferred into the gap or juncture between the feed roller 32 and the contra-roller 33, only one sheet is allowed to pass through the second gap or juncture between the feed roller 32 and the contra-roller 33 toward the first juncture between the main feed roller 40 and the delivery roller 42. This is because, between the feed roller 32 and the contra-roller 33, force is applied to a bottom sheet of two sheets in a direction toward the main feed roller 40, while force is applied to a top sheet of two sheets in a direction toward the discharge port 22.

The sheet of the media m, having been discharged out of the second gap or juncture between the feed roller 32 and the contra-roller 33, is fed into the first juncture between the main feed roller 40 and the delivery roller 42, more specifically, between the delivery roller 42 and the belt 41 wound on the main feed roller 40. As a sheet of the media m passes through the gap between the main feed roller 40 and the delivery roller 42, the sensor 50 detects a front end of the sheet. When the front end of a sheet is detected, a rear end of the sheet is still in contact with the pickup roller 30.

When the front end of the sheet is detected by the sensor 50, the sensor 50 generates a signal which is used to stop the driving force supplied to the pickup roller 30 and the feed roller 32. As a result, neither the pickup roller 30, nor the feed roller 32, receives a driving force. However, since both the pickup roller 30 and the feed roller 32 have rotation shafts with one-way bearings, they experience idle rotation due to the transfer of the media m.

The main feed roller 40 and the delivery roller 42 rotate at a speed three or four times faster than a rotation speed of the feed roller 32 and are in contact with each other with an engagement force three times larger than an engagement force between the pickup roller 30 and the media m. Therefore, each sheet of the media m is moved rapidly along a transfer route in a delivery module, after the sheet is introduced into the juncture between the main feed roller 40 and the delivery roller 42. The contra-roller 33 is continuously rotated by a driving force, so as to prevent another sheet of the media m from being simultaneously transferred out of the media cassette 20.

When each sheet of the media m has completely passed through the juncture between the main feed roller 40 and the delivery roller 42, the sensor 50 or another sensor detects such a passage and signals that power for rotating the pickup roller 30 and the feed roller 32 may be supplied again, should another sheet of media need to be discharged.

Thereafter, a next sheet of the media m, waiting to be discharged is separated from the other sheets of media and is transferred to the second gap or juncture between the feed roller 32 and the contra-roller 33 by the pickup roller 30. Then, the operation as described above is repeated, so as to allow a desired number of sheets of the media m to be discharged out of the media cassette 20.

According to the present invention, as described in detail above, the following advantages can be obtained. Media having various sizes can be filled in and dispensed from one automatic media dispenser without any change in the design or construction of the automatic media dispenser. Therefore, the present invention allows one automatic media dispenser to dispense different sizes of media.

Further, the present invention allows each sheet of media to be transferred after a previous sheet is completely separated and discharged from a media cassette. Therefore, according to the present invention, each sheet of media can be separated and discharged from a media cassette in a more smooth and exact manner.

The scope of the present invention is not limited by the illustrated embodiments but defined by the appended claims. It will be apparent that those skilled in the art can make various modifications and changes within the scope of the invention defined by the claims.

What is claimed is:

1. A media transfer apparatus for an automatic media dispenser, comprising:

a media cassette for holding media at an angle, the media cassette including:

a discharge port located at a front of the media cassette;

an inclined guide plate located at the front of the media cassette; and a push plate configured to push media in the automatic media dispenser towards the front of media cassette and against the inclined guide plate;

a pickup roller for contacting media waiting to be discharged, so as to separate and transfer the media sheet by sheet, wherein the media is arranged above the pickup roller and the inclined guide plate is located below the pickup roller;

a main feed roller and a delivery roller facing each other to form a first gap or juncture, said main feed roller and said delivery roller for transferring a separated sheet of the media along a media transfer route; and a sensor for detecting a front end of a separated sheet, having passed through said first gap or juncture between said main feed roller and said delivery roller, wherein when said sensor detects the front end of the separated sheet, a power supplied to said pickup roller is stopped, and transfer of the separated sheet continues by rotation of said main feed roller and said delivery roller, wherein said pickup roller is connected to a rotation shaft by a one-way bearing, so that said pickup roller experiences idle rotation without receiving power when said sensor detects the front end of the separated sheet of media, the idle rotation of said pickup roller allowing continued transfer of the sheet of media, said media transfer apparatus is suitable for dispensing sheets of media having different dimensions, wherein said first gap or juncture is a first juncture, and wherein a distance from a contact point between said main feed roller and said delivery roller to a contact point between said pickup roller and a sheet of media to be dispensed, is approximately equal to a dimension of a smallest sheet of medium to be dispensed, with the dimension being measured in a direction in which the smallest sheet of media is transferred.

2. The media transfer apparatus as claimed in claim 1, further comprising:

a first feed roller and a contra-roller facing each other to form a second gap or juncture, wherein said second gap or juncture is disposed in the media transfer route between said pickup roller and said first gap or juncture between said main feed roller and said delivery roller, and wherein said first feed roller and said contra-roller rotate in a same direction, so as to prevent more than one sheet of the media from being simultaneously transferred through said second gap or juncture.

3. The media transfer apparatus as claimed in claim 2, wherein said first feed roller is connected to a rotation shaft by a one-way bearing, so that said first feed roller experiences idle rotation without receiving power when said sensor detects the front end of the separated sheet of media, the idle rotation of said first feed roller allowing continued transfer of the sheet of media.

4. The media transfer apparatus as claimed in claim 3, wherein said contra-roller is driven by a driving force supplied to said contra-roller even when said first feed roller experiences idle rotation.

5. The media transfer apparatus as claimed in claim 1, wherein a distance between said pickup roller and said first gap or juncture is smaller than a dimension of a sheet of media to be dispensed, with the dimension being measured in a direction in which the sheet of media is transferred.

6. The media transfer apparatus as claimed in claim 1, wherein said main feed roller rotates at a speed at least three times faster than a rotation speed of said pickup roller.

7. The media transfer apparatus as claimed in claim 6, wherein said first gap or juncture is a first juncture, and wherein said main feed roller and the delivery roller are in contact with each other by an engagement force at least three times larger than an engagement force between said pickup roller and a sheet of media waiting for discharge.

8. A media transfer apparatus for an automatic media dispenser, comprising:

a media cassette for holding media at an angle, the media cassette including:

a discharge port located at a front of the media cassette; an inclined guide plate located at the front of the media cassette; and a push plate configured to push media in the automatic media dispenser towards the front of media cassette and against the inclined guide plate;

a pickup roller for contacting media waiting to be discharged, so as to separate and transfer the media sheet by sheet, wherein the media is arranged above the pickup roller and the inclined guide plate is located beneath the pickup roller;

a main feed roller and a delivery roller facing each other to form a first gap or juncture, said main feed roller and said delivery roller for transferring a separated sheet of the media along a media transfer route;

a first feed roller and a contra-roller facing each other to form a second gap or juncture, wherein said second gap or juncture is disposed in the media transfer route between said pickup roller and said first gap or juncture between said main feed roller and said delivery roller, wherein said first feed roller and said contra-roller rotate in a same direction, so as to prevent more than one sheet of the media from being simultaneously transferred through said second gap or juncture, and wherein a frictional engagement between said first feed roller and a sheet of media is greater than a frictional engagement between said contra-roller and the same sheet of media; and a sensor for detecting a front end of a separated sheet, having passed through said first gap or juncture between said main feed roller and said delivery roller.

9. The media transfer apparatus as claimed in claim 8, wherein when said sensor detects the front end of the separated sheet, a power supplied to said pickup roller is stopped, and transfer of the separated sheet continues by rotation of said main feed roller and said delivery roller.

10. The media transfer apparatus as claimed in claim 9 wherein said first feed roller is connected to a rotation shaft by a one-way bearing, so that said first feed roller experiences idle rotation without receiving power when said sensor detects the front end of the separated sheet of media, the idle rotation of said first feed roller allowing continued transfer of the sheet of media.

11. The media transfer apparatus as claimed in claim 10, wherein said contra-roller is driven by a driving force supplied to said contra-roller even when said first feed roller experiences idle rotation.

12. A media transfer method for an automatic media dispenser, the media being one of bank notes, checks, tickets, and certificates, said method comprising the steps of:

separating media waiting for discharge from a media cassette of the automatic media dispenser sheet by sheet, using a pickup roller, the media being loaded in the media cassette at an angle such that the media is arranged above the pick-up roller;

detecting a front end of the separated sheet having passed through a first gap or juncture between a main feed roller and a delivery roller, using a sensor;

stopping operation of the pickup roller when the sensor detects the front end of the separated sheet, wherein said pickup roller is connected to a rotation shaft by a one-way bearing, so that said pickup roller experiences idle rotation without receiving power when said sensor detects the front end of the separated sheet of media, the idle rotation of said pickup roller allowing continued transfer of the sheet of media; and transferring the separated sheet using the main feed roller and the delivery roller, wherein the main feed roller rotates at a speed at least three times faster than a rotation speed of the pickup roller.

13. A media transfer method for an automatic media dispenser, the media being one of bank notes, checks, tickets, and certificates, said method comprising the steps of:

separating media waiting for discharge from a media cassette of the automatic media dispenser sheet by sheet, using a pickup roller, the media being loaded in the media cassette at an angle such that the media is arranged above the pick-up roller;

detecting a front end of the separated sheet having passed through a first juncture between a main feed roller and a delivery roller, using a sensor, the main feed roller and the delivery roller being in contact with each other by an engagement force at least three times larger than an engagement force between the pickup roller and the media waiting for discharge;

stopping operation of the pickup roller when the sensor detects the front end of the separated sheet, wherein said pickup roller is connected to a rotation shaft by a one-way beating, so that said pickup roller experiences idle rotation without receiving power when said sensor detects the front end of the separated sheet of media; the idle rotation of said pickup roller allowing continued transfer of the sheet of media; and transferring the separated sheet using the main feed roller and the delivery roller.

14. A media transfer apparatus for an automatic media dispenser, comprising:

a media cassette for holding media at an angle, the media cassette including:

a discharge port located at a front of the media cassette; an inclined guide plate located at the front of the media cassette; and a push plate configured to push media in the automatic media dispenser towards the front of media cassette and against the inclined guide plate;

a pickup roller for contacting media waiting to be discharged, so as to separate and transfer the media sheet by sheet, wherein the media is arranged above the pickup roller, the inclined guide plate includes an opening, and the pick-up roller is located to extend into the opening of the guide plate;

a main feed roller and a delivery roller facing each other to form a first gap or juncture, said main feed roller and said delivery roller for transferring a separated sheet of the media along a media transfer route; and a sensor for detecting a front end of a separated sheet, having passed through said first gap or juncture between said main feed roller and said delivery roller, wherein when said sensor detects the front end of the separated sheet, a power supplied to said pickup roller is stopped, and transfer of the separated sheet continues by rotation of said main feed roller and said delivery roller, wherein said pickup roller is connected to a rotation shaft by a one-way bearing, so that said pickup roller experiences idle rotation without receiving power when said sensor detects the front end of the separated sheet of media, the idle rotation of said pickup roller allowing continued transfer of the sheet of media, said media transfer apparatus is suitable for dispensing sheets of media having different dimensions, wherein said first gap or juncture is a first juncture, and wherein a distance from a contact point, between said main feed roller and said delivery roller to a contact point between said pickup roller and a sheet of media to be dispensed, is approximately equal to a dimension of a smallest sheet of medium to be dispensed, with the dimension being measured in a direction in which the smallest sheet of media is transferred.

* * * * *